United States Patent [19]

Townsend

[11] Patent Number: 4,549,458

[45] Date of Patent: Oct. 29, 1985

[54] METHOD AND MEANS OF APPORTIONING AND CUTTING MEAT

[75] Inventor: Ray T. Townsend, Des Moines, Iowa

[73] Assignee: Townsend Engineering Company, Des Moines, Iowa

[21] Appl. No.: 557,967

[22] Filed: Dec. 5, 1983

[51] Int. Cl.[4] ..... B26D 7/06

[52] U.S. Cl. ..... 83/42; 83/244; 83/268; 83/278

[58] Field of Search ..... 83/42, 222, 241, 278, 83/268, 221, 243, 244, 246; 17/32

[56] References Cited

U.S. PATENT DOCUMENTS

| | | | |
|---|---|---|---|
| 2,119,660 | 6/1938 | Varley | 83/244 |
| 2,311,843 | 2/1943 | Lee | 83/42 X |
| 2,696,442 | 12/1954 | Allbright | 17/49 X |
| 3,212,377 | 10/1965 | Bennett | 83/42 |
| 3,776,073 | 12/1973 | Runge | 83/278 X |
| 4,011,779 | 3/1977 | Berg | 83/268 X |
| 4,318,321 | 3/1982 | De Mattos | 83/209 X |
| 4,331,054 | 5/1982 | Williams et al. | 83/278 X |

*Primary Examiner*—Frank T. Yost

*Attorney, Agent, or Firm*—Zarley, McKee, Thomte, Voorhees & Sease

[57] ABSTRACT

The present invention provides a method and apparatus for apportioning and cutting a loaf of meat into slices of equal thickness. The apparatus includes a frame, a meat compartment in the frame adapted to receive the loaf of meat, a measuring device on the frame for apportioning the loaf into a predetermined number or thickness of slices to be cut, a cutting blade on the frame to cut the loaf into the plurality of slices, an advancement ram connected to the measuring device for advancing the loaf after each slice is cut, and a control system interconnecting the measuring device and cutting blade so that the cutting blade will sequentially cut the loaf into the plurality of slices of equal thickness. The measuring device includes a first elongated member having calibrations of equal increments for substantially simultaneously apportioning the number and thickness of slices into which the loaf is to be cut. The method of apportioning the loaf of meat into a plurality of equal slices includes sensing the length of the loaf, dividing the loaf into a plurality of slices of substantially equal thickness with the measuring device, and cutting the loaf with the cutting blade into the plurality of slices of equal thickness.

18 Claims, 12 Drawing Figures

METHOD AND MEANS OF APPORTIONING AND CUTTING MEAT

BACKGROUND OF THE INVENTION

In the meat industry, it is necessary to slice cuts of butchered meat into thinner portions before distributing the meat to the consumer. It is often desirable to slice the meat such that the portions are of equal thickness. However, when the meat is cut into slices of equal thickness, it is common to have waste at either or both ends of the butchered quantity of meat. Such waste is costly and undesirable.

Therefore, a primary objective of the present invention is the provision of a method and means of cutting a quantity of meat into slices having equal thickness without wasting any of the meat.

A further objective of the present invention is the provision of a method and means of portioning meat into slices of selected equal thickness.

A further objective of the present invention is the provision of a method and means for automatically sensing the length of the quantity of meat and cutting it into slices of predetermined yet approximately equal thicknesses.

A further objective of the present invention is the provision of a method and means of cutting a quantity of meat having any length into slices of equal thickness.

A further objective of the present invention is the provision of a means of cutting a quantity of meat into slices of equal thickness which is easy and safe to operate, economical to manufacture, and durable in use.

SUMMARY OF THE INVENTION

The apparatus of the present invention for cutting meat into a plurality of slices of equal thickness generally comprises a frame, a meat compartment in the frame for receiving the meat, a measuring means on the frame for sensing the length of the meat and for determining the number and thickness of the slices into which the meat is to be cut, cutting means on the frame for cutting the meat into the desired slices, and a control means which operatively connects the measuring means and cutting means so that the cutting means will sequentially cut the meat into slices of equal thickness. The apparatus also includes a ram for advancing the meat within the meat compartment an increment of distance equal to the thickness of each slice after each slice is cut. The measuring means includes an elongated bar having a plurality of equally spaced notches which are utilized in substantially simultaneously determining the number and thickness of the slices into which the meat is to be cut.

To operate the apparatus of the present invention, a quantity of meat is placed in the meat compartment of the frame. The length of the meat is then determined and the thickness of the slices to be cut is selected through proper positioning of the notched bar. Since the notched bar is positioned at an angle with respect to the longitudinal movement of the meat, the measurement means automatically establishes the number of slices to be cut without producing any waste at either end of the quantity of meat. The control means is then actuated such that the cutting means sequentially cuts the meat into a plurality of slices of equal thickness.

DETAILED DESCRIPTION OF THE DRAWINGS

Figure 4:
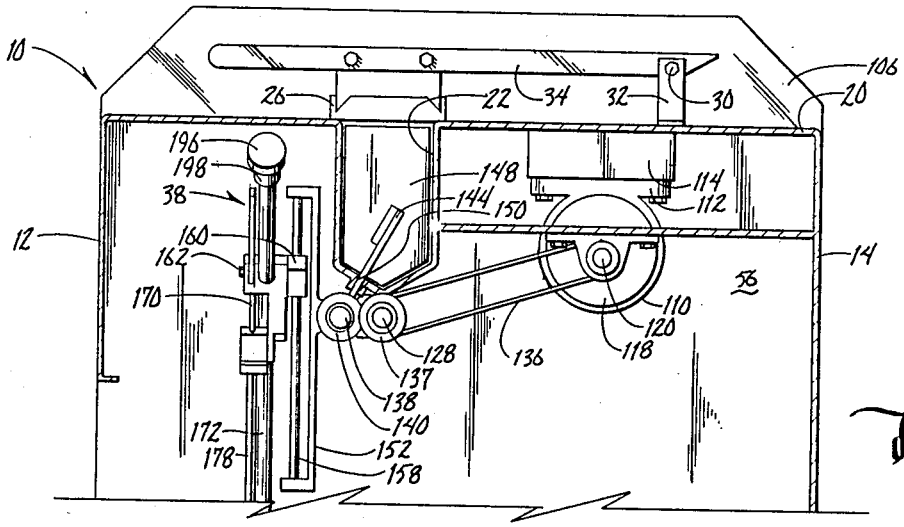
FIG. 4 is a partial elevation sectional view taken along line 4—4 of FIG. 2.
Figure 2:
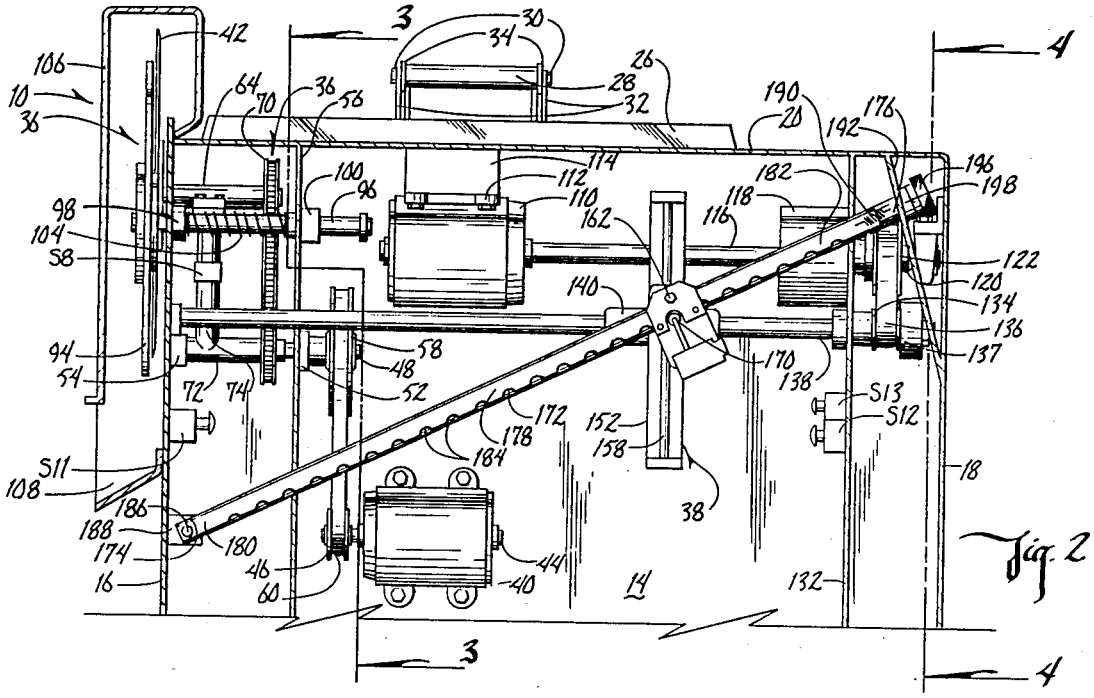
FIG. 2 is a partial front sectional view taken along line 2—2 of FIG. 1.
Figure 3:
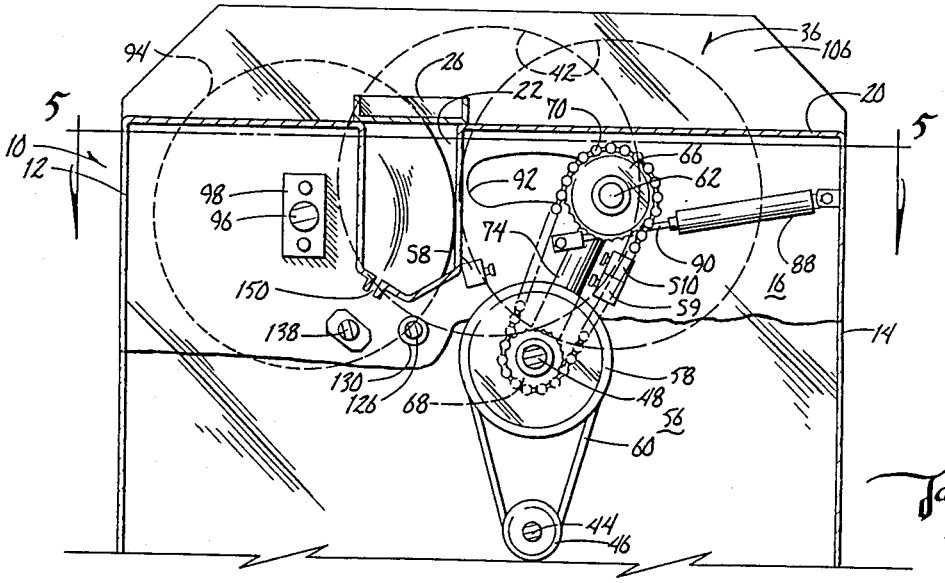
FIG. 3 is a partial elevation sectional view taken along line 3—3 of FIG. 2.

The device of the present invention for portioning meat into slices of equal thickness is generally designated by the numeral 10. Device 10 includes a frame comprising a front wall 12, a back wall 14, opposite end walls 16 and 18, and a top wall 20. Top wall 20 of the frame includes a chamber 22 therein for receiving a quantity of meat 24 which is closed by a cover 26. Cover 26 may have a handle 28 mounted thereon for facilitating access to chamber 22. Cover 26 may be pivotally attached to top 20 of device 10 as shown by pin 30 extending through mounting brackets 32 and support bars 34 in FIG. 4.

Figures 6, 7:
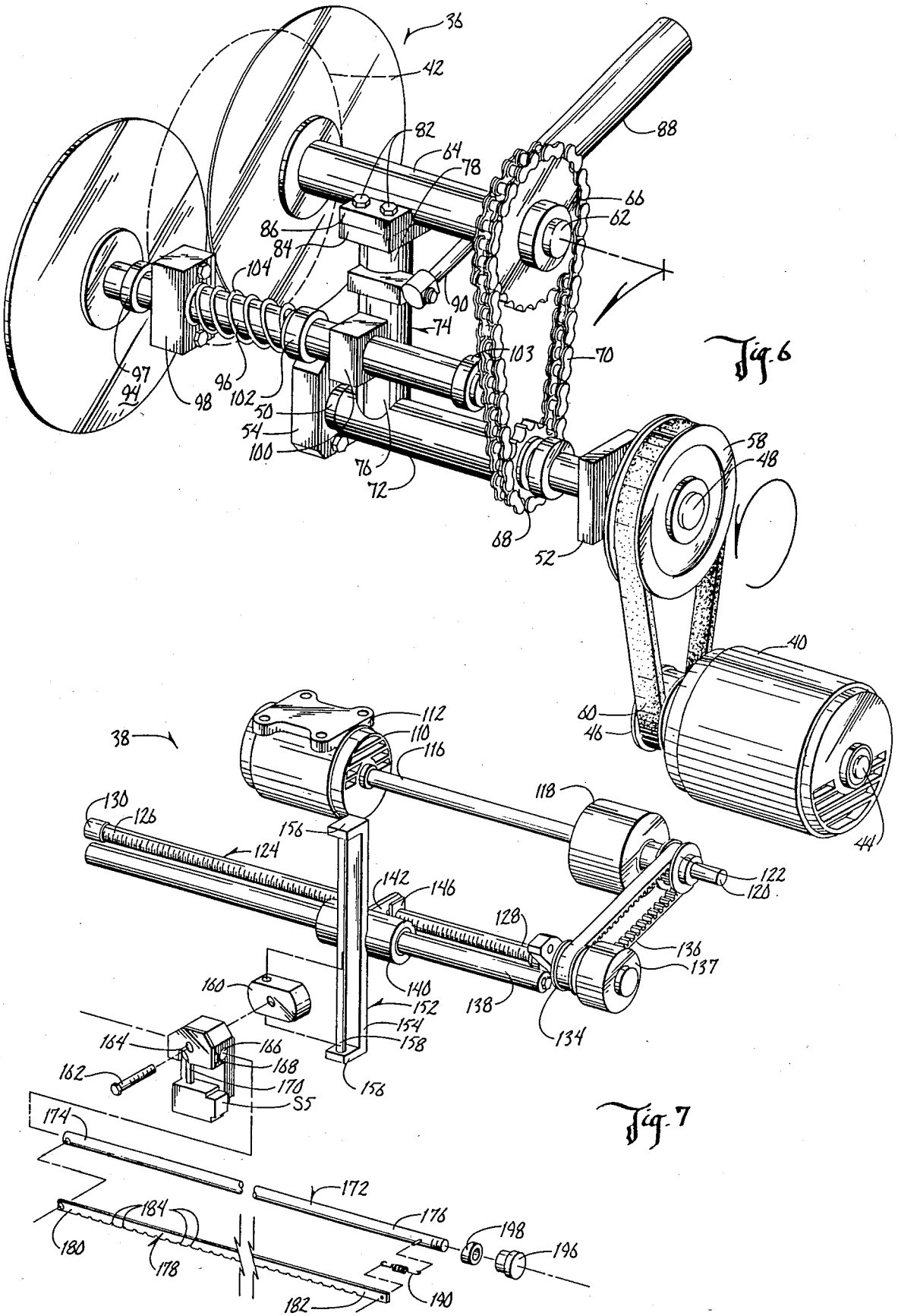
FIG. 6 is a perspective view of the cutting mechanism of the present invention.
FIG. 7 is an exploded perspective view of the portioning mechanism of the present invention.
Figure 11:
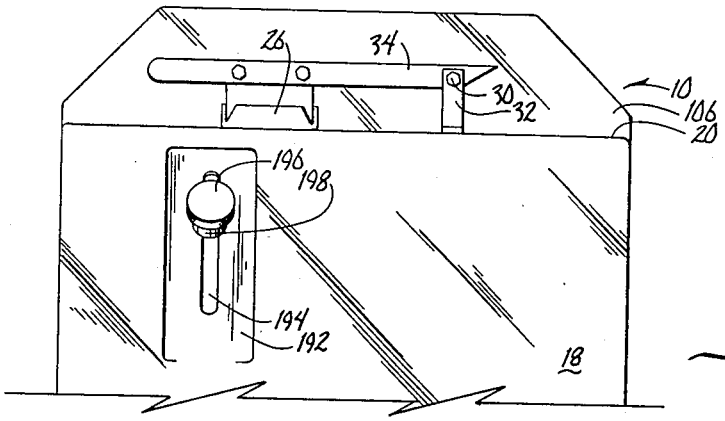
FIG. 11 is a partial rear elevation view of the apparatus.

Mounted within device 10 is a cutting mechanism 36 and a portioning mechanism 38 which are in operative communication with one another via an electrical control system. As most clearly seen in FIG. 6, cutting mechanism 36 includes a motor 40 which drives a cutting blade 42 through a plurality of shafts and linkages. Motor 40 has a shaft 44 with a pulley 46 at one end thereof. A second shaft 48 is journaled within a collar or bushing 50 at one end thereof and a similar mounting guide 52 adjacent the opposite ends thereof. Bushing 50 is connected to end wall 16 with a mounting plate 54. Mounting guide 52 is attached to an interior wall 56 within the frame of device 10. Bushing 50 and mounting guide 52 thus provide support for shaft 48 such that it can be rotated. Shaft 48 also has a pulley 58 rigidly fixed to one end thereof. A belt 60 is trained about pulleys 46 and 58.

Cutting blade 42 is mounted upon a shaft 62 which is journaled within a bushing 64. Rigidly attached to shaft 62 opposite the end having blade 42 is a sprocket 66. Shaft 48 also has a sprocket 68 rigidly affixed thereto. A chain 70 is trained about sprocket 66 and 68. Thus, the linkage of motor shaft 44 with shaft 48 via belt 60 trained about pulleys 46 and 58, and the secondary linkage of shafts 48 and 62 via chain 70 trained about sprockets 66 and 68 permits blade 42 to be rotated upon shaft 62 when motor 40 is actuated.

Cutting mechanism 36 also includes a pneumatic or hydraulic system such that blade shaft 62 can be pivoted along its longitudinal axis about the longitudinal axis of shaft 48. An additional bushing 72 is mounted upon shaft 48 such that shaft 48 can rotate therein. An arm 74 is welded or otherwise connected to bushing 72 at one end 76 thereof. The opposite end 78 of arm 74 is connected to bushing 64 in any convenient manner, such as bolts 82 extending through a pair of mounting plates 84 and 86 attached to arm 74 and bushing 64, respectively. A conventional air cylinder 88 is fixed at one end to wall 14 of device 10. Air cylinder 88 includes a piston (not shown) therein mounted on a piston rod 90 which extends out the opposite end of air cylinder 88 and which is fixed to arm 74 by conventional means. Air cylinder 88 is connected to an air supply such that piston rod 90 can be extended or retracted thereby causing arm 74 to move blade shaft 62 and blade 42 along an arcuate path. An arcuate slot 92 is provided in wall 16 to provide a guide for collar 80 when blade 42 is being pivoted.

As will be explained, meat within chamber 22 is forced outwardly periodically and rotating blade 42 is pivoted to cut the meat 24 into slices of equal thickness. As meat 24 is forced outwardly, the end of the meat engages a platter 94 which is mounted on a spring-loaded shaft 96 so as to exert a force in the opposite direction upon meat 24. Shaft 96 is slidably supported by a mounting block 98 which is attached to end wall 16 and a mounting block 100 attached to a bracket 101 secured to top wall 20. Shaft 96 is free to slide along its longitudinal axis through blocks 98 and 100. A collar 102 is attached to shaft 96 between blocks 98 and 100. A spring 104 is compressed between collar 102 and mounting block 98 so as to tend to force platter 94 inwardly in a direction opposite that of the advancing meat. Inward movement of shaft 96 is limited by a collar 97. Cutting blade 42 and pressure platter 94 may be enclosed by a housing 106 adjacent end wall 16 of device 10. Housing 106 includes a lower shute 108 from which the sliced meat is removed.

As best seen in FIGS. 7–10, the portioning mechanism 38 of the device is generally comprised of a plurality of elongated shafts. Portioning mechanism 38 includes a motor 110 mounted to top wall 20 of device 10 by conventional motor mounts 112 and 114. Motor 110 has a shaft 116 extending therefrom which is in operative communication with a conventional clutch 118. Clutch 118 also has a shaft 120 extending therefrom upon which a pulley 122 is mounted.

Portioning mechanism 38 also includes an elongated threaded rod 124 having opposite ends 126 and 128. End 126 of rod 124 is journaled within a collar 130 attached to end wall 16 of device 10. Rigidly fixed to rod 124 adjacent end 128 is a pulley 134. A belt 136 is trained about pulleys 122 and 134 such that rod 124 rotates when clutch 118 is engaged to rotate shaft 120. Also attached to end 128 of rod 124 is a conventional brake 137. The linkage of pulleys 122 and 134 via belt 136 causes rod 124 to rotate when motor 110 is actuated and clutch 118 is engaged. Brake 137 prevents rod 124 from rotating when clutch 118 is disengaged.

Mounted within the framework of device 10 and parallel to threaded rod 124 is a guide shaft 138. Mounted for sliding movement upon shaft 138 is a collar 140. Rigidly fixed to collar 140 is a first flange 142 and a second flange 144. Fixed to flange 142 is a plate member 146 having a hole therethrough which is threaded for mating engagement with the threads of rod 124. Secured to flange 144 is a ram element 148 having the general configuration of meat chamber 22. Flange 144 extends through a slot 150 extending along the length of chamber 22 such that ram 148 fits closely within the confines of chamber 22. When rod 124 is rotated, the threaded plate member 146 causes collar 140 and attached ram 148 to move along the longitudinal axis of guide shaft 138 so that ram 148 forces meat 24 outwardly from chamber 22.

Also attached to collar 140 is a vertically extending C-shaped member 152 having an upright portion 154 connected to collar 140 and flanges 156 extending outwardly from the opposite ends of upright portion 154. Extending between opposite flanges 156 is a vertically disposed rod 158. Slidably mounted upon rod 158 is a switch bracket 160 to which a proportionality switch S5 is pivotally mounted via bolt 162. Switch S5 has a first hole 164 extending therethrough for receiving bolt 162, a second hole 166 extending therethrough perpendicular to hole 164 and a rectangular slot 168 extending therethrough parallel to hole 166. Switch S5 has a spring-loaded roller 170 which moves so as to open and close the switch.

Slidably extending through hole 166 is an elongated shaft 172 having opposite ends 174 and 176. Connected to shaft 172 and extending through slot 168 of switch S5 is a bar element 178 having opposite ends 180 and 182 and a plurality of notches 184 therebetween which are aligned with roller 170 for engagement thereby. End 174 of shaft 172 and end 180 of bar 178 are pivotally connected by a bolt 186 to a flange 188 secured to end wall 16 of device 10. End 182 of bar 178 is connected adjacent end 176 of shaft 172 by a spring 190 having opposite ends connected to shaft 172 and bar 178, respectively. End wall 18 of device 10 has a slanted surface 192 thereon having a slot 194 therein for receiving end 176 of shaft 172. End 176 of shaft 172 is free to move within slot 194 and can be held in a selected position by tightening a nut 196 onto the threads of end 176. A washer 198 may be provided to insure that shaft 172 is held in place when nut 196 is tightened thereon.

It can be seen from FIGS. 7–10 that when clutch 118 is engaged, shaft 120 rotates which in turn causes threaded rod 124 to rotate via the interconnection of pulleys 122 and 134 with belt 136. The threaded hole in plate 146 follows the motion of the threads of rotating rod 124 so as to cause collar 140 to move accordingly along guide shaft 138. Since the longitudinal axis of shaft 172 is positioned at some angle with respect to the longitudinal axes of rod 124 and shaft 138, as collar 140 and member 152 mounted thereto move along shaft 138, switch bracket 160 slides upwardly and downwardly along rod 158 such that switch S5 will slide along shaft 172 and roller 170 will drop into successive notches 184 on bar 178.

Device 10 includes an electric circuit having a plurality of switches and relays which controls the operation of device 10. In initially setting up device 10 for operation, a power switch S1 is activated to provide energy to device 10. Switch S1 is a conventional push/pull on/off switch and is mounted on the exterior surface of front wall 12 of device 10. The activation of switch S1 provides 24 volts alternating current to the control circuit and 90 volts direct current to clutch 118 and brake 137 of device 10. Next, a master switch S2 is flipped to the on position to energize the relays (not shown) of motors 40 and 110. Switch S2 is also located on front panel 12 of device 10. Set-up start switch S3, which is located along side switches S1 and S2 on the front panel 12 of device 10, is then activated to engage clutch 118 thereby rotating threaded rod 124 such that collar 140 is moved forwardly upon shaft 138 until ram 148 contacts the quantity of meat 24 in chamber 22. Meat 24 is forced against platter 94 which is moved forwardly against spring 104 until set-up stop switch S4, which is normally closed and located adjacent another collar 103 on the end of shaft 96, is disengaged. This automatic activation of switch S4 disengages clutch 118 and engages brake 137 to stop the rotation of rod 124 and the forward movement of collar 140 and switch S5. The angle of shaft 172 is then manually adjusted by moving end 176 within slot 194 of end wall 18 until roller 170 of switch S5 drops into an adjacent notch 184 on bar 178. Nut 196 is then tightened to hold shaft 172 in place. This final step completes the initial set-up of device 10 so that it is ready to slice meat 24 into slices of equal thickness. At this point in time, clutch 118 is disengaged and brake 137 is engaged.

To initiate the cutting cycle of device 10, a blade actuation switch S7 located on front panel 12 is then flipped to the "on" position to allow air from a compressed air source to actuate the valve (not shown) on air cylinder 88. Then, a run-start switch S6 on front panel 12 is actuated which in turn actuates an associated relay. The actuation of the air cylinder valve causes piston rod 90 to be extended such that cutting mechanism 36 pivots about shaft 48 whereby blade 42, which is constantly rotating while motor 40 runs, moves to cut the first slice of meat 24 which has been pushed outwardly by ram 148 and into engagement with platter 94 in the initial set-up of device 10. When blade 42 completes the cut of the meat, blade arm 74 contacts a blade return switch S8 mounted on end wall 16 which reverses the air flow direction in the valve of air cylinder 88 such that piston rod 90 is retracted to pivot cutting mechanism 36 about shaft 48 and return cutting mechanism 36 to its initial position.

When cutting mechanism 36 is nearly returned to its initial position, arm 74 contacts incremental portioner start-up switch S9 located on an interior wall 132 within the frame of device 10. Switch S9 engages clutch 118 and disengages brake 137 such that rod 124 rotates to move switch S5 out of notch 184 in bar 178 that roller 170 of switch S5 previously engaged. Switch S9 merely provides an initial pulse to clutch 118 so that roller 170 of switch S5 moves out of a notch 184. When roller 170 of switch S5 is out of a notch 184, the engagement of the clutch is maintained until roller 170 drops into the next adjacent notch 184 wherein clutch 118 is disengaged and brake 137 is engaged. While clutch 118 is engaged and collar 140 is moving forwardly upon shaft 138, ram 148 advances meat 24 an additional increment equal to the thickness of the slice to be cut. This increment is equal to the product of the linear distance between adjacent notches 184 times the cosine of the angle measured from a horizontal plane to the longitudinal axis of shaft 172.

Simultaneously with the activation of switch S9, a cylinder return shut-off switch S10 mounted on wall 132 is contacted by blade arm 74 or by bushing 64. Switch S10 reverses the direction of air flow within the valve of air cylinder 88 so that cutting mechanism 36 is again ready to pivot such that blade 42 will cut another slice of meat 24.

Figure 1:
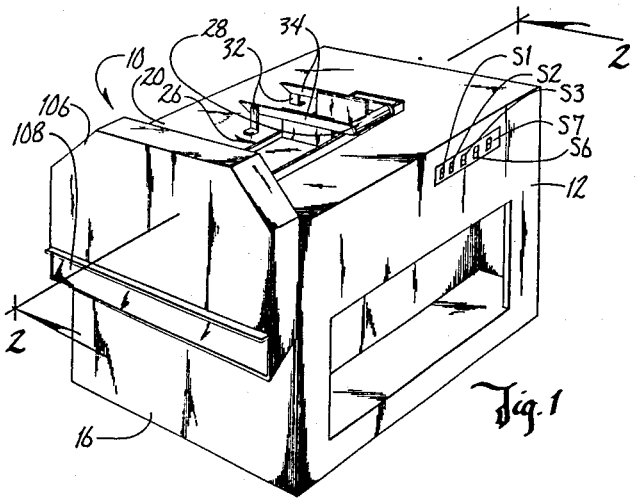
FIG. 1 is a perspective view of the apparatus of the present invention for portioning meat into slices of equal thickness.
Figure 10:
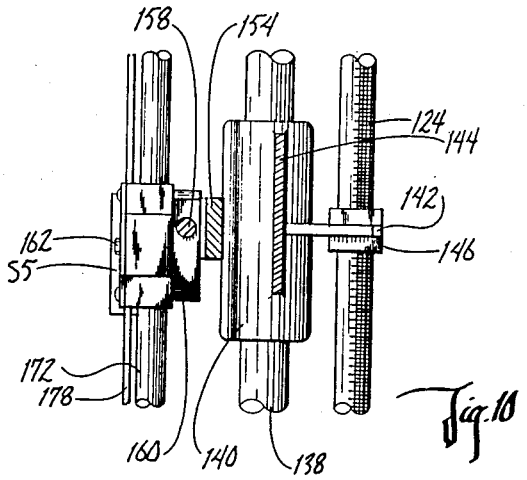
FIG. 10 is a view taken along line 10—10 of FIG. 9.
Figure 8:
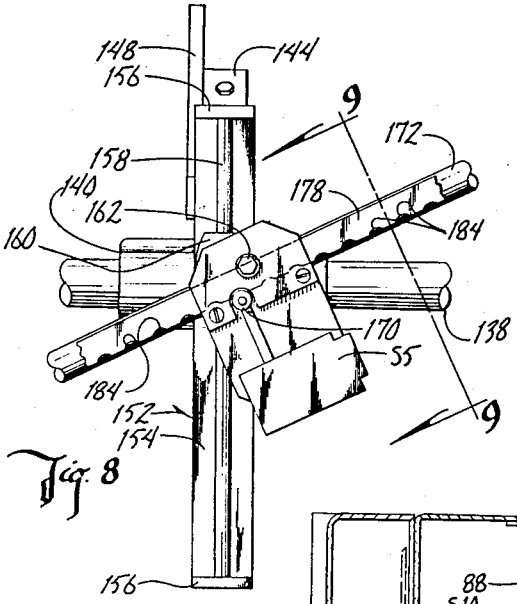
FIG. 8 is a partial front view of the portioning device of the apparatus.
Figure 9:
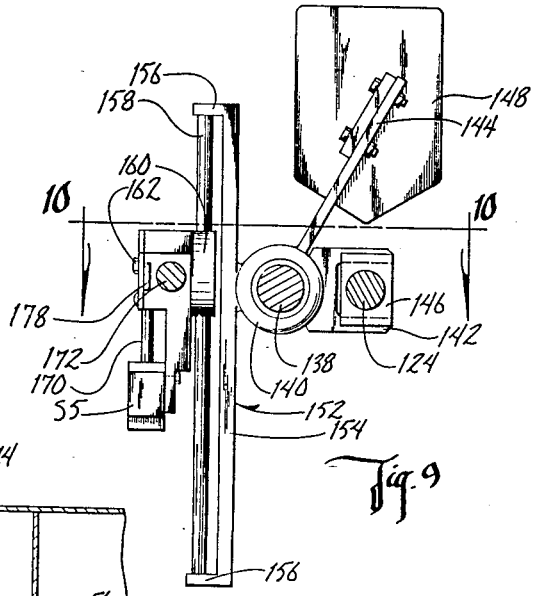
FIG. 9 is a view taken along line 9—9 of FIG. 8.
Figure 5:
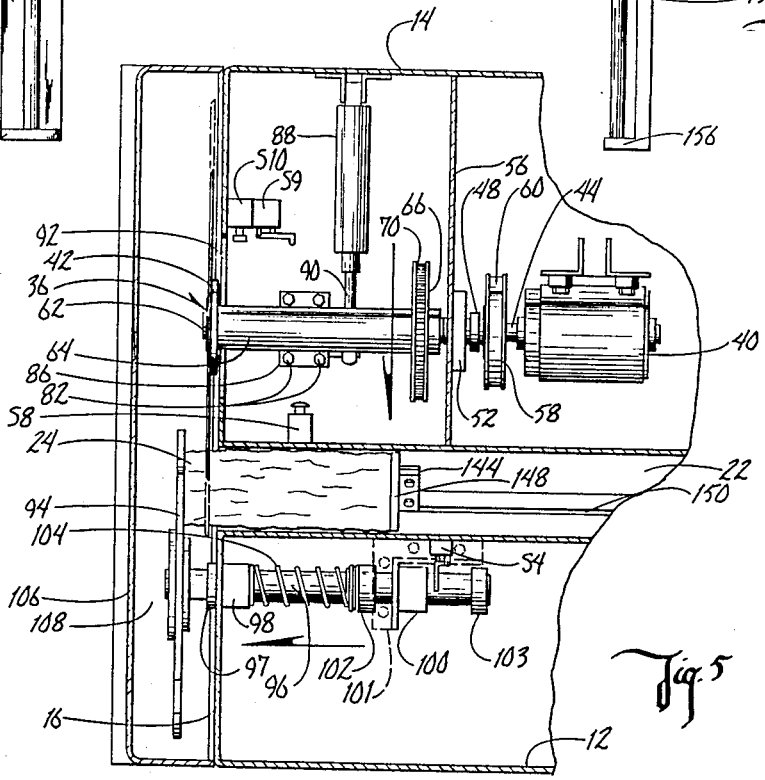
FIG. 5 is a partial plan sectional view taken along line 5—5 of FIG. 3.

The sequence of pivoting cutting mechanism 36 such that blade 42 cuts a slice of meat, returning cutting mechanism 36 to its initial position, and the corresponding engagement and disengagement of clutch 118 such that collar 140 moves along shaft 138 whereby switch S5 slides along shaft 172 as roller 170 of switch S5 moves from one notch 184 to the next adjacent notch on bar 178 is repeated until the last slice of meat has been cut. When the last piece of meat has been cut, upright 154 of C-shaped member 152 hits ram reverse switch S11 mounted on end wall 16 to reverse the direction of rotation of shaft 116 of motor 110 such that switch S5 is returned to end 176 of shaft 172. When switch S5 reaches end 176 of shaft 172, upright 154 of C-shaped member 152 contacts reset switch S12 mounted on wall 132 which again reverses the direction of rotation of shaft 116 of motor 110. Also, when switch S5 is returned to its starting position, upright 154 actuates safety switch S13 secured to wall 132 which disengages clutch 118 and engages brake 137. As seen in FIG. 8, ram 148 is offset with respect to roller 170 of switch S5 so that the last slice of meat is cut when roller 170 reaches the last of notches 184 in bar 178.

Figure 12:
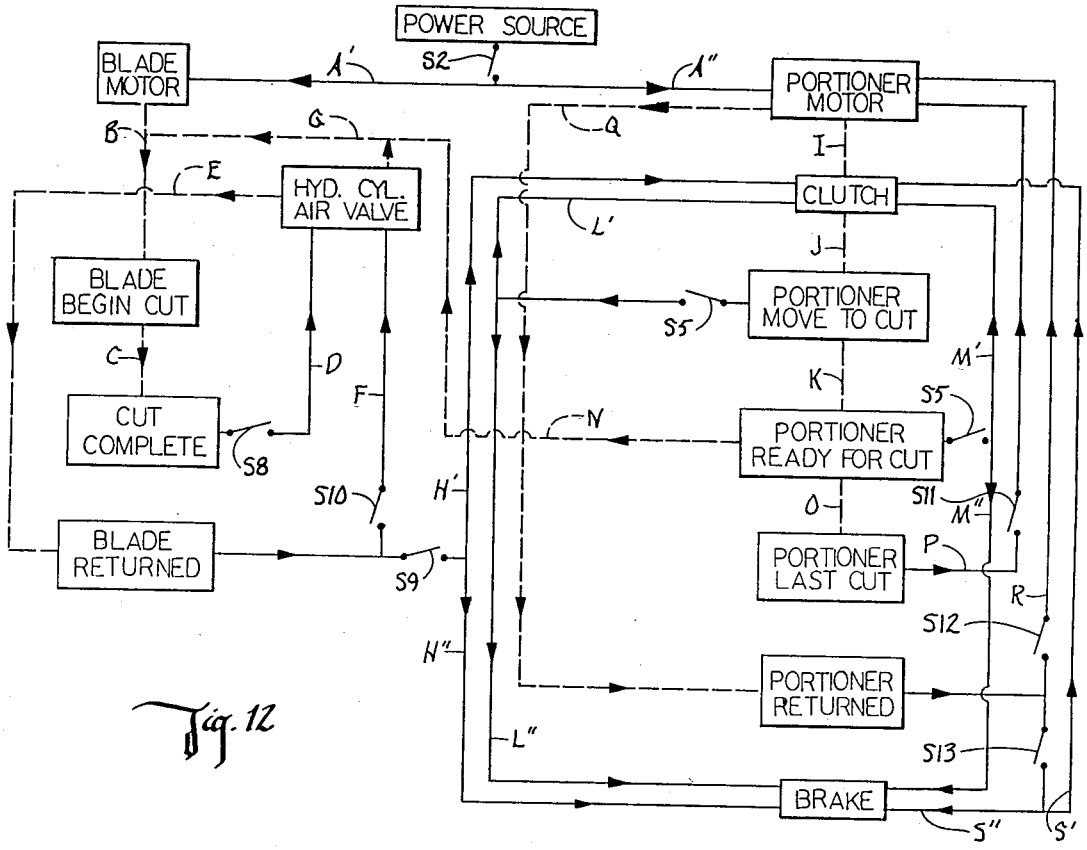
FIG. 12 is a schematic showing the control system for operation of the apparatus of the present invention.

FIG. 12 is a simplified schematic of the operation of the portioning device of the present invention as it operates after initial set-up of the device is completed. Thus, switches S1–S4 have all been sequentially activated as described above, the angle of shaft 172 has been manually adjusted such that roller 170 of switch S5 is in a notch 184 of bar 178, the meat is in position for the first slice to be cut therefrom, and switches S7 and S6 have been activated. The repetitive cutting cycle of device 10 can thus be described by the schematic of FIG. 12. In FIG. 12, solid lines represent electrical communications while dotted lines represent mechanical movement.

Referring to FIG. 12, an electrical wire from the power source contains switch S2 which provides power to blade motor 40 through electrical line A′ and power to portioner motor 110 through electrical wire A″.

Blade motor 40 causes blade 42 to rotate as air cylinder 88 pivots blade 42 to cut the meat, as represented by broken lines B and C. When the cut is complete, blade arm 74 contacts switch S8 such that the direction of air flow within the air valve of air cylinder 88 is reversed via electrical wire D. The reversal of the air valve causes blade 42 to be returned to its initial position, as represented by dashed line E. When the blade is finally returned, blade arm 74 activates switch S10 which "sets up" the air valve circuit to be energized through electrical communication F, thereby allowing the air flow within the air valve of air cylinder 88 to be reversed the next time switch S5 drops into a notch, such that blade 42 is again ready to cut a slice of meat.

At the same time that switch S10 is activated, knife arm 74 contacts switch S9 which serves the double function of engaging clutch 118 via wire H′ and disengaging brake 137 via wire H″. It is again noted that portioner motor 110 drives clutch 118 as represented by dashed line I and that the clutch, when engaged, mechanically drives portioner mechanism 38 as represented by dotted line J. Switch S9 provides an impulse to clutch 118 such that roller 170 of switch S5 is moved out of a notch 184 in bar 178. While roller 170 is out of a notch 184 and portioner mechanism 36 is moving as represented by broken line K, switch S5 operates to maintain the engagement of clutch 118 via wire L′ and simultaneously maintains the disengagement of brake 137 via wire L″. When roller 170 of switch S5 finally drops into the next adjacent notch 184 of bar 178, switch S5 operates to serve the double function of disengaging clutch 118 via wire M′ and engaging brake 137 via wire M″. At this stage, portioner mechanism 38 has completed its movement as represented by dashed line K and is ready for the meat to be cut, cutting mechanism 36 has been returned to its initial position and is ready to be pivoted by air cylinder 88 so as to cut the next slice of meat 24, as represented by broken line N.

The above sequence of steps including blade pivoting and portioner moving, is repeated until the last slice of meat has been cut. After the last cut has been made, as represented by dotted line O, upright member 154 of C-shaped member 152 contacts switch S11 which serves to reverse the direction of rotation of shaft 116 of motor 110 via wire P, such that portioner mechanism 38 is carried back to its initial starting position, as represented by broken line Q. When portioner mechanism 38 is finally returned to its starting position, upright member 154 contacts switch S12 which again reverses the direction of motor 110, via wire R, such that device 10 can be reset for slicing a new quantity of meat. Switch S13 is activated simultaneously with and in the same manner as switch S12. Switch S13 serves a dual function of disengaging clutch 118 through electrical communication S′ and engaging brake 137 through electrical communication S″.

Through the repetitive sequence of steps described above, the quantity of meat 24 can be cut into slices of equal thickness. Knife 42 cuts a slice of meat each time roller 170 of switch S5 drops into a notch 184 on bar 178. Because of the interconnections between collar 140, ram 148, C-shaped member 152, and switch S5, ram 148 automatically advances the quantity of meat 24 an equal distance each time clutch 118 is engaged to move roller 170 to the next adjacent notch 184. The notches are equally spaced, thus the meat is advanced an equal distance for each slice to be cut therefrom.

It is understood that bar 178 may be interchanged with similar bars in which the spacing between notches 184 is different in one bar than another. By having a plurality of bars 178 with varied spacing between notches 184, the thickness of the slices of meat can be selected as desired. Once the angle of shaft 172 is set, a simple calculation will determine what spacing between notches 184 is required for any particular thickness of slice. The quotient of the thickness of the slice to be cut divided by the cosine of the angle of shaft 172 with respect to a horizontal plane will equal the required distance between notches 184 of bar 178.

It can thus be seen that the device of the present invention cuts the quantity of meat into slices of equal thickness due to the geometric principle that the distance between two parallel lines can be divided into equal segments by intersecting the lines with a member having a plurality of equally spaced divisions such that one of such divisions intersect each of said lines. In the present invention, the ends of the quantity of meat represents two parallel lines and bar 178 represents a member having equally spaced divisions. The manual adjustment of shaft 172 serves to set one of the notches 184 of bar 178 at one end of the quantity of meat 24 while the opposite end of bar 178 is fastened to end wall 16 adjacent the plane of cutting blade 42. Thus, a simple geometric principle has been utilized to provide a device capable of portioning a quantity of meat into slices having equal thickness without producing any waste at either end of the quantity of meat.

What is claimed is:

1. A method of apportioning and cutting a loaf of meat having opposite ends defining and substantially parallel planes into a plurality of slices of substantially equal thickness, comprising:

intersecting each of said planes with one of a plurality of equally spaced linear calibrations whereby the calibrations between said parallel planes automatically apportion said loaf into slices of substantially equal thickness, periodically cutting successive slices from one end of said loaf, and advancing said loaf a distance equal to the thickness of the slice to be cut after each slice is cut from said one end of said loaf.

2. The method of claim 1 wherein each slice is removed from said loaf after being cut from said loaf, and said loaf is maintained under compression throughout the cutting of said slices.

3. The method of claim 1 wherein said length of said loaf is mechanically determined.

4. The method of claim 1 wherein the number of said slices is determined and the thickness of said slices is determined substantially simultaneously.

5. A method of cutting a loaf of meat having opposite ends defining substantially parallel planes into a predetermined number of slices, comprising:

intersecting each of said planes with one of a plurality of equally spaced linear calibrations whereby the calibrations between said parallel planes automatically apportion said loaf into said predetermined number of slices, each slice having substantially equal thickness, periodically cutting successive slices from one end of said loaf, and advancing said loaf a distance equal to the thickness of the slice to be cut after each slice is cut from said one end of said loaf.

6. The method of claim 5 wherein each slice is removed from said loaf after being cut from said loaf.

7. The method of claim 5 wherein said length of said loaf is mechanically determined.

8. The method of claim 5 wherein the number of said slices is determined and the thickness of said slices is determined substantially simultaneously.

9. An apparatus for apportioning and cutting meat into a plurality of slices of equal thickness, comprising, a frame, a meat compartment in said frame adapted to receive a loaf of meat having opposite ends defining substantially parallel planes, cutting means on said frame adapted to cut said loaf into said plurality of slices, advancement means operatively connected to said cutting means for advancing said loaf after each slice is cut, and apportionment means operatively connected to said advancement means for controlling said advancement of said loaf by said advancement means, said apportionment means including a first elongated member having equally spaced calibrations thereon, one of said calibrations intersecting each of said parallel planes whereby the calibrations between said parallel planes automatically apportion said loaf into said slices of substantially equal thickness.

10. The apparatus of claim 9 wherein said advancement means is operatively connected to said apportionment means so that said loaf is sequentially moved longitudinally an increment of distance equal to the thickness of each slice after each slice is cut.

11. The apparatus of claim 10 wherein said advancement means maintains pressure on said loaf throughout the cutting of said slices.

12. The apparatus of claim 10 wherein said apportionment means substantially simultaneously apportions the number and thickness of the slices into which said loaf is to be cut.

13. The apparatus of claim 9 wherein said first elongated member can be exchanged with a second elongated member having calibrations of equal increments, said increments of said calibrations of said first member being different from said increments of said calibrations of said second member.

14. An apparatus for apportioning and cutting meat into a predetermined number of slices each having substantially equal thickness, comprising, a frame, a meat compartment in said frame adapted to receive a loaf of meat having opposite ends defining substantially parallel planes, cutting means on said frame adapted to cut said loaf into a plurality of slices, advancement means operatively connected to said cutting means for advancing said loaf after each slice is cut, and apportioning means operatively connected to said advancement means for controlling said advancement of said loaf by said advancement means, said apportioning means including a first elongated member having equally spaced calibrations thereon, one of said calibrations intersecting each of said parallel planes whereby the calibrations between said parallel planes automatically apportion said loaf into said number of slices to be cut.

15. The apparatus of claim 14 wherein said advancement means is operatively connected to said apportionment means so that said loaf is sequentially moved longitudinally an increment of distance equal to the thickness of each slice after each slice is cut.

16. The apparatus of claim 14 wherein said advancement means maintains pressure on said loaf throughout the cutting of said slices.

17. The apparatus of claim 14 wherein said apportionment means substantially simultaneously apportions the number and thickness of slices into which said loaf is to be cut.

18. The apparatus of claim 14 wherein said first elongated member can be exchanged with a second elongated member having calibrations of equal increments, said increments of said calibrations of said first member being different from said increments of said calibrations of said second member.

* * * * *